US006998627B1

(12) United States Patent
Korenev

(10) Patent No.: US 6,998,627 B1
(45) Date of Patent: Feb. 14, 2006

(54) CHANNEL FOR TRANSPORT OF ELECTRON BEAM FROM ACCELERATOR TO IRRADIATED PRODUCT

(75) Inventor: Sergey A. Korenev, Mundelein, IL (US)

(73) Assignee: STERIS Inc., Temecula, CA (US)

( * ) Notice: Subject to any disclaimer, the term of this patent is extended or adjusted under 35 U.S.C. 154(b) by 0 days.

(21) Appl. No.: 10/962,883

(22) Filed: Oct. 12, 2004

(51) Int. Cl.
*G21G 4/00* (2006.01)

(52) U.S. Cl. ..... 250/492.3; 250/492.1; 250/492.2

(58) Field of Classification Search ..... 250/492.1, 250/492.2, 492.3
See application file for complete search history.

(56) References Cited

U.S. PATENT DOCUMENTS 5,847,401 A * 12/1998 McKeown et al. .. 250/396 ML
6,713,773 B1 * 3/2004 Lyons et al. ..... 250/492.3
6,764,657 B1 * 7/2004 Korenev et al. ..... 422/186
6,815,691 B1 * 11/2004 Loda et al. ..... 250/455.11
6,833,551 B1 * 12/2004 Avnery ..... 250/492.3
6,914,253 B1 * 7/2005 Korenev et al. ..... 250/492.3
2002/0060294 A1 * 5/2002 Korenev et al. ..... 250/427
2004/0079900 A1 * 4/2004 Korenev et al. ..... 250/492.3
2004/0101435 A1 * 5/2004 Centanni et al. ..... 422/22
2005/0077472 A1 * 4/2005 Korenev ..... 250/360.1

* cited by examiner

*Primary Examiner*—John R. Lee
*Assistant Examiner*—Johnnie L Smith, II
(74) *Attorney, Agent, or Firm*—Kusner & Jaffe; Michael A. Centanni

(57) ABSTRACT

A device for transport of an electron beam from an accelerator to a product to be irradiated, comprised of a passive plasma channel for forming a low density plasma by ionizing gas molecules in a chamber under low pressure conditions. The device being adjustable in size such that the chamber formed by the device occupies a majority of the distance between the e-beam accelerator and the product to be irradiated.

25 Claims, 6 Drawing Sheets

CHANNEL FOR TRANSPORT OF ELECTRON BEAM FROM ACCELERATOR TO IRRADIATED PRODUCT

FIELD OF THE INVENTION

The present invention relates generally to an apparatus for the irradiation of objects and the like, and more particularly to a device for forming a chamber that focuses an electron beam for irradiating a product.

BACKGROUND OF THE INVENTION

It is known that the physical properties of a material may be altered by exposing the material to electron (e-beam) radiation. In this respect, manufacturers treat certain products, such as plastic articles or animal feed, to produce a desired alteration in the products. In a conventional product irradiation process, a product is moved along a conveyor through an e-beam that scans across, i.e. traverses, the path of the conveyor. The e-beam is scanned across the conveyor by means of a scan horn that is a fixed distance from the surface of the conveyor. Depending upon the size of the product to be irradiated, the distance between the scan horn and the product may vary.

As the e-beam travels through air from the scan horn to the product, instabilities occur in the e-beam. These instabilities in the e-beam are the result of uncontrolled air plasma that is formed by the e-beam as a result of ionization of gases molecules, such as oxygen and nitrogen molecules in the air. Once the electron beams exit the accelerator through a foil window in the scan horn, the beam tends to increase in cross section, and the beam current density decreases. These events lead to two (2) negative effects in the irradiation process.

First, there is a decrease in the value of absorbed dose in the irradiated product.

Second, the angle of incidence of the scanning electron beam on the product decreases the penetration of the e-beam into the product. A 20% variation of absorbed dose may occur.

A still further problem with irradiating products in air is that certain products give off gases that accumulate at the surface of the product during irradiation. This accumulation of gases leads to uncontrolled variation of the parameters of the air plasma. The accumulation of gases may also lead to chemical reactions on the surface of a product being irradiated.

It is also known to use a high current e-beam from a pulsed electron accelerator to irradiate product(s). A high current beam from a pulsed electron accelerator (without a scanning system) exhibits the effects of the space charge in vacuum or air because of the high current and the high charge of the e-beam. For example, the diameter of an e-beam in vacuum for a beam current of 1 kA and a kinetic energy of 500 keV may increase 10 times over a distance of 12 cm. The propagation of this type of e-beam in air has the same problems with non-stability as described above. An additional problem is that the variation of current density tends to lead to a variation of dose distribution in an irradiated product.

The present invention overcomes these and other problems and provides a method and apparatus for the transport of an electron beam from the accelerator to a product to be irradiated.

SUMMARY OF THE INVENTION

In accordance with a preferred embodiment of the present invention, there is provided a system for irradiating objects. The system comprises a conveyor for conveying objects along a predetermined path. An e-beam scanning device is disposed a predetermined distance from the path. The e-beam scanning device is operable to scan an e-beam across the path at a specific location along the path. A chamber is disposed between the scanning device and the specific location along the path. The chamber is dimensioned to maintain the scanning e-beam within the confines of the chamber and to occupy a majority of the distance between the e-beam scanning device and an object at the specific location. There is provided a means for creating vacuum conditions in the chamber that is suitable for the creation of a plasma within the chamber when the e-beam is scanned through the chamber.

In accordance with another aspect of the present invention, there is provided a method of irradiating an object, comprising the steps of:

- providing a chamber between a source of an electron beam (e-beam) and an object to be irradiated by the electron beam, the chamber being dimensioned to occupy a majority of the space between the source and the object; and
- maintaining a vacuum within the chamber while directing an e-beam through the chamber into the object, the vacuum in the chamber being at a level to create conditions within the chamber suitable for forming a plasma within the chamber.

In accordance with another aspect of the present invention, there is provided an e-beam transport device. The device is comprised of a housing that defines a chamber. The housing is dimensioned to withstand a vacuum of less than 2 Torr within the chamber. A window for inputting an electron beam and a window for outputting an electron beam forming a part of the housing. The foil is oriented in the housing to be aligned with the path of an e-beam through the housing, wherein the e-beam enters the chamber through the window for inputting an electron beam and exits the chamber through the window for outputting an electron beam. A vacuum-generating device is connected to the chamber. The vacuum-generating device is capable of creating a vacuum between 2 Torr and 0.1 Torr within the chamber.

In accordance with still another aspect of the present invention, there is provided a method of irradiating an object, comprising the steps of:

- positioning a chamber between a source of an electron beam (e-beam) and an object to be irradiated;
- creating a vacuum within the chamber, the vacuum being at a level of 0.2 Torr or less; and
- scanning an e-beam through the chamber toward the object.

An advantage of the present invention is a method and apparatus for the transport of an e-beam for irradiating articles.

Another advantage of the present invention is a method and apparatus as described above that increases the efficiency of the irradiation process.

Another advantage of the present invention is a method and apparatus as described above that facilitates using lower-energy e-beams to irradiate the articles.

A still further advantage of the present invention is a method and apparatus as described above that facilitates a more homogeneous distribution of absorbed doses in the irradiated article.

A still further advantage of the present invention is a method and apparatus as described above that is adjustable to irradiate objects of different dimensions.

These and other objects will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
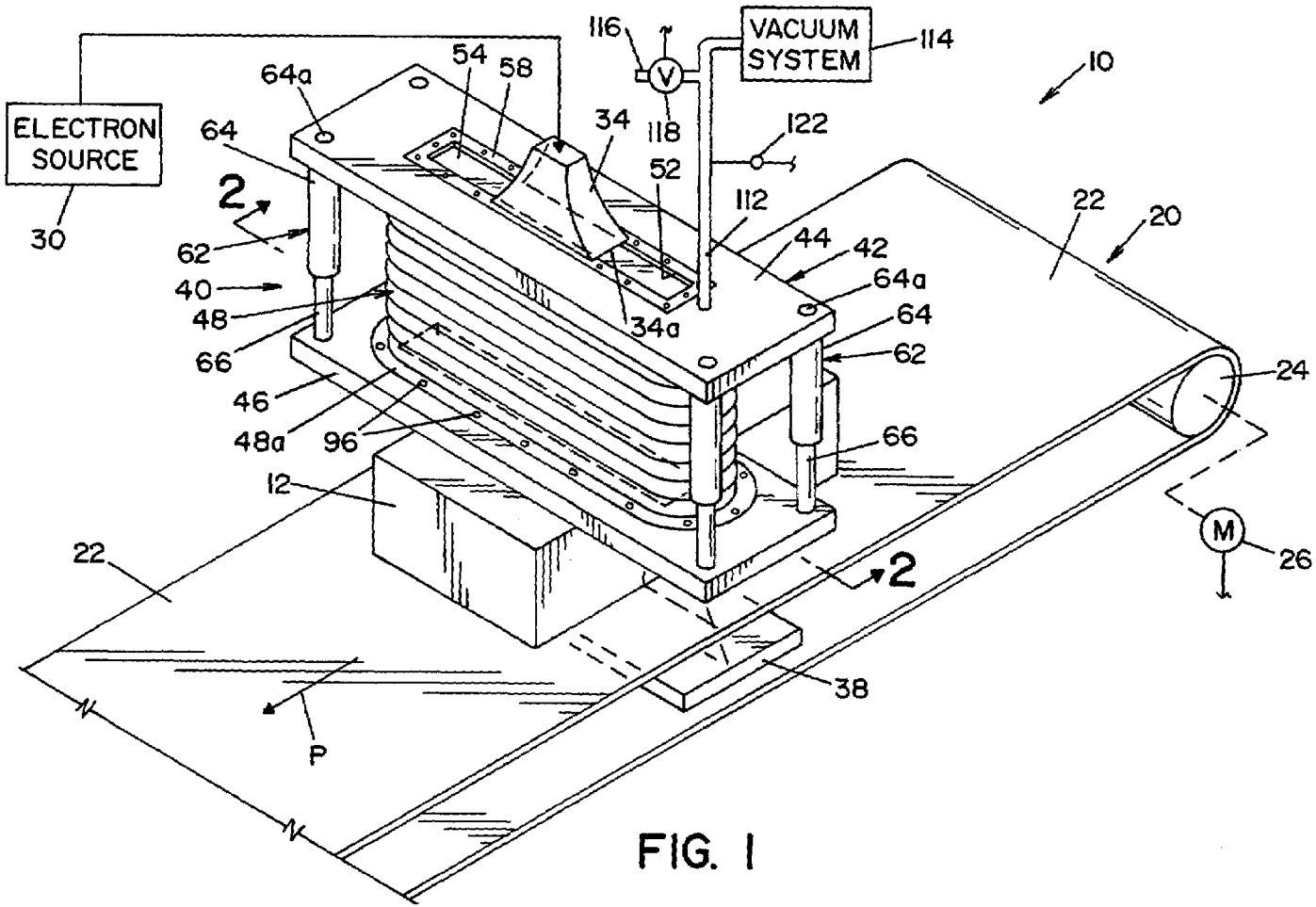
FIG. 1 is a perspective view of a process for irradiating objects, showing a chamber for the transport of an e-beam, according to a preferred embodiment of the present invention.

Referring now to the drawings wherein the showings are for the purpose of illustrating a preferred embodiment of the invention only and not for the purposes of limiting the same, FIG. 1 shows a process 10 for irradiating products or objects 12. The object 12 to be irradiated is shown moving along a conveyor system 20. Conveyor system 20 includes a generally endless conveyor belt 22 that is movable over a pair of rollers 24. (Only one roller is illustrated in the drawing.) One roller 24 is driven by a motor 26 that is schematically illustrated in FIG. 1. An electron accelerator 30, schematically illustrated in FIG. 1, generates an electron beam 32 (best seen in FIG. 2) that is conveyed through a scan horn 34 that scans beam 32 back and forth, in a conventionally known manner. Conveyor system 20 is disposed relative to scan horn 34 such that e-beam 32 from scan horn 34 traverses back and forth across conveyor belt 22. In this respect, any product or object 12 moving along conveyor system 20 will intersect and pass through the scanned e-beam 32.

In the embodiment shown, an electron-absorbing device 38 is disposed below the upper run of conveyor belt 22. A beam transport device 40 is associated with scan horn 34 to maintain the focus of e-beam 32, as shall be described in greater detail below. Beam-focusing device 40 is generally comprised of a housing 42 having a first end member 44, a second end member 46, and an intermediate, expandable and collapsible wall member 48. In the embodiment shown, first and second end members 44, 46 are generally comprised of elongated, rectangular plates having a longitudinal length approximately equal to the width of conveyor belt 22. First end member 44 is dimensioned to be mounted below an opening 34*a* in scan horn 34. In this respect, first end member 44 may be fixedly mounted to scan horn 34, or may be mounted to a structure (not shown) supporting scan horn 34. In this respect, first end member 44 is stationary relative to scan horn 34.

Figure 2:
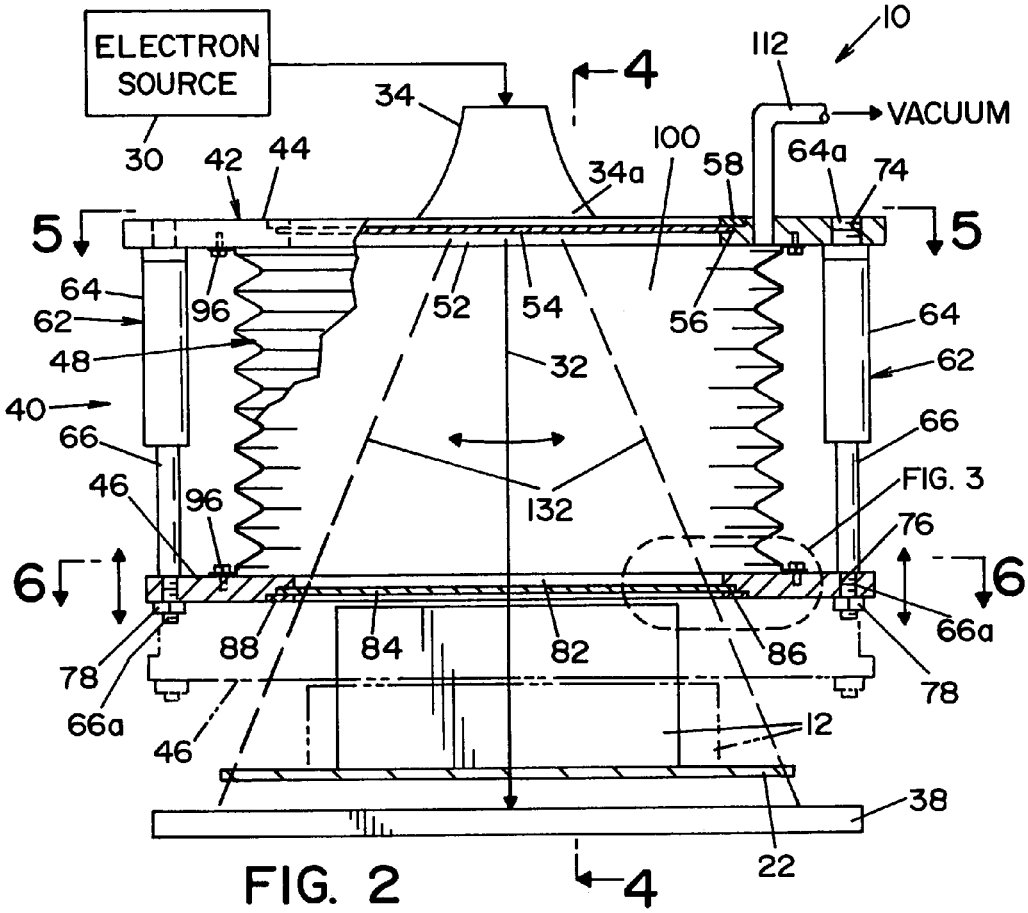
FIG. 2 is a sectional view taken along lines 2—2 of FIG. 1.
Figure 4:
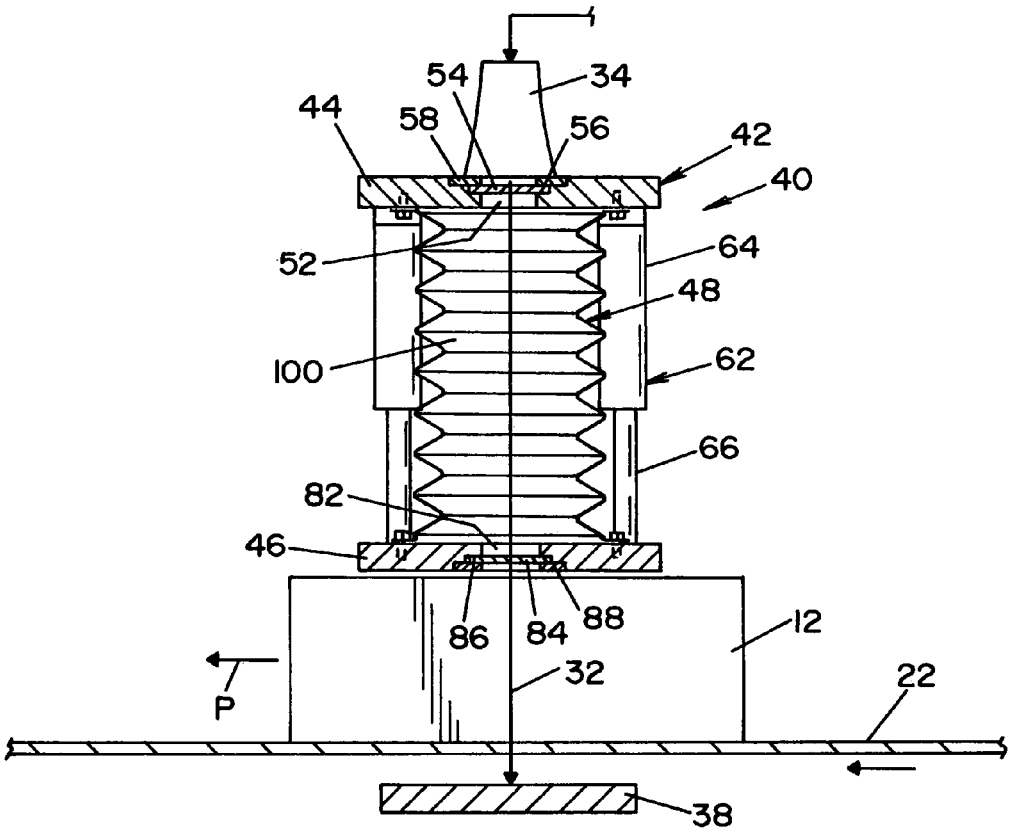
FIG. 4 is a sectional view taken along lines 4—4 of FIG. 2.
Figure 5:
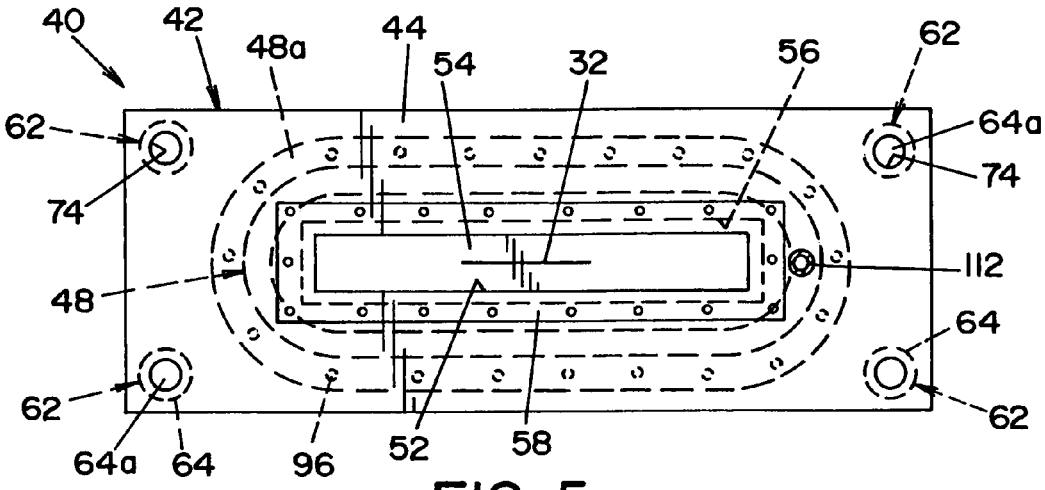
FIG. 5 is a planned view taken along lines 5—5 of FIG. 2.

An opening 52 is formed in first end member 44. In the embodiment shown, opening 52 is rectangular in shape. Opening 52 is disposed below scan horn 34 to be in registry with opening 34*a* in scan horn 34, as best seen in FIGS. 2 and 4. A foil window 54 is disposed across opening 52. Foil window 54 is preferably formed of a metallic material, and more preferably, is a metal foil, such as by way of example and not limitation, Ti, A1 Be with thickness 20–200 microns on dependence. Foil window 54 is disposed within a rectangular recess 56 formed around opening 52 in the surface of first end member 44. A frame-shaped retainer 58 maintains panel 54 within recess 56, as illustrated in FIGS. 2 and 4.

Second end member 46 is adapted to be movable relative to scan horn 34 and first end member 44. In the embodiment shown, cylinders 62 are attached to the corners of first and second end members 44, 46. Each cylinder 62 has a housing portion 64 that is attached to first end member 44, and a movable rod portion 66 that is attached to second end member 46. More specifically, housing portion 64 of each cylinder 62 has a threaded extension 64*a* that is matingly received in a threaded opening 74 in first end member 44. Each rod portion 66 of cylinder 62 includes a threaded shank 66*a* that extends through a hole 76 in second end member 46. A conventional threaded nut 78 secures rod portion 66 of cylinder 62 to second end member 46. Cylinders 62 may be hydraulic or pneumatic, and preferably are controlled simultaneously so as to allow second member 46 to be automatically moved relative to first end member 44. As will be appreciated by those skilled in the art, other mechanical arrangements are contemplated for connecting second end member 46 to first end member 44 so as to allow adjustable movement of second end member 46 relative to first end member 44. By way of example and not limitation, such means may include a drive screw, or guide shafts with mechanical-locking devices.

Figure 6:
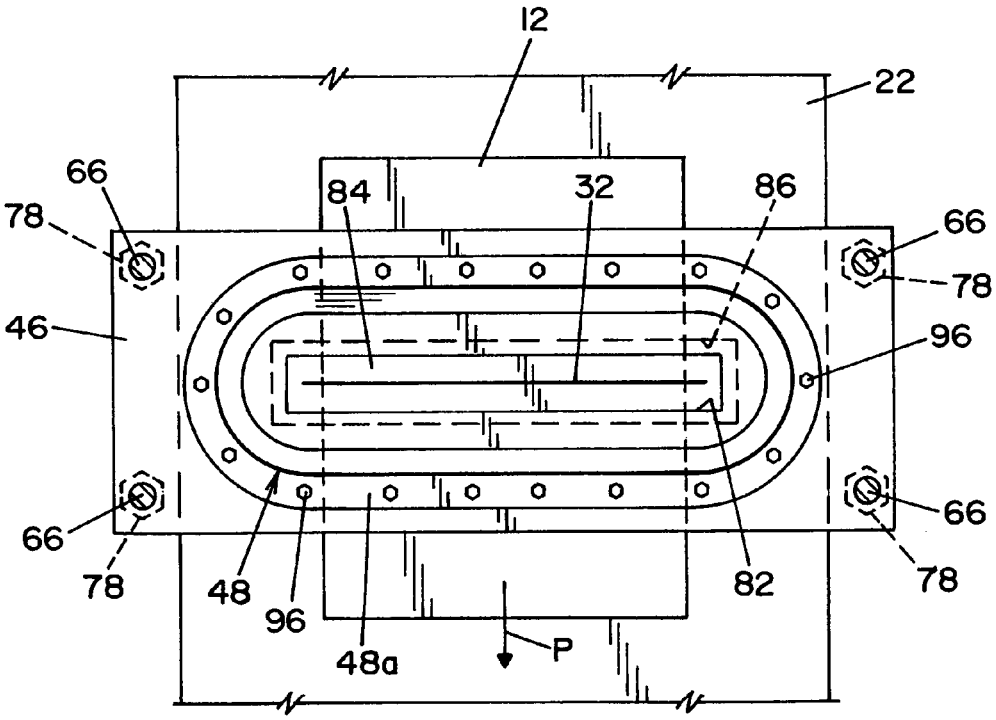
FIG. 6 is a sectional view taken along lines 6—6 of FIG. 2.

An elongated rectangular opening 82, best seen in FIG. 6, is formed in second end member 46. Opening 82 is oriented to be transverse to the path of conveyor belt 22. A foil window 84 is disposed within opening 82 in second end member 46. Foil window 84 is disposed in a rectangular recess 86 formed in second end member 46 around opening 82. A frame-shaped retainer 88 is mounted to second end member 46 by conventional fasteners to secure foil window 84 to second end member 46 in an airtight fashion.

Figure 3:
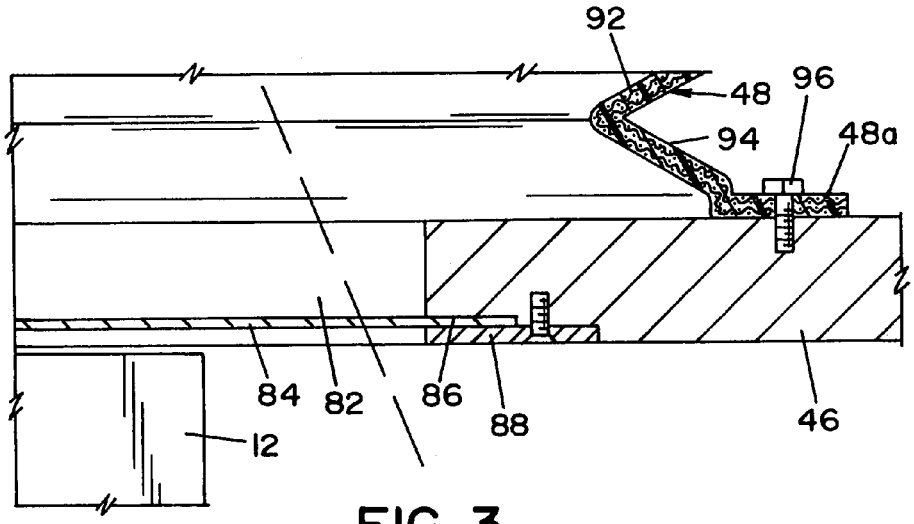
FIG. 3 is an enlarged view of the area designated in FIG. 2.

Wall member 48 is disposed between, and is attached to, first end member 44 and second end member 46. In the embodiment shown, wall member 48 is comprised of an expandable and collapsible, accordion-like structure. Wall member 48 has an obround shape and is dimensioned to be larger, i.e., longer and wider, than elongated opening 82 in second end member 46. Wall member 48 has an outwardly extending flange 48*a* formed at each end thereof, as best seen in FIG. 3. In one preferred embodiment, wall member 48 is comprised of layers of a flexible metal cloth or screen 92 having a flexible, resilient polymeric material 94 covering the same, as illustrated in FIG. 3.

A plurality of conventional fasteners 96 extends through flange 48*a* of wall member 48 to secure wall member 48 to first and second end members 44, 46.

An airtight chamber 100 is defined within housing 42 of beam-transport device 40. A conduit 112 communicates with chamber 100. Conduit 112 is connected to a vacuum-generating system 114. Vacuum-generating system 114 is comprised of a vacuum pump driven by a motor (not shown). Vacuum-generating system 114 is capable of creating a predetermined vacuum within chamber 100. Vacuum-generating system 114 is preferably capable of generating a vacuum down to 0.01 Torr ($1.3\times10^{-5}$ atmospheres, 1.22 Pascals). A secondary conduit 116 branches off of conduit 112, as illustrated in FIG. 1. Secondary conduit 116 communicates with the atmosphere. A valve 118 is disposed in secondary conduit 116 to control flow therethrough. A sensor 122 is attached to conduit 112 to monitor the pressure levels within chamber 100.

Process 10 shall now be further described by discussing the operation thereof. Conveyor system 20 is dimensioned to convey objects or products 12 to be irradiated along a path "P" that intersects the path of scanned e-beam 32. Scan horn 34 is disposed relative to conveyor system 20 to scan across the width of conveyor belt 22. In the embodiment shown, the path of scanned e-beam 32 is perpendicular to the path of conveyor belt 22.

Beam-transport device 40 is disposed between scan horn 34 and the surface of conveyor belt 22. Second end member 46 of beam-transport device 40 is adjustable relative to the surface of conveyor belt 22, such that objects or products 12 can pass thereunder. In this respect, beam-transport device 40 is adjusted such that chamber 100 occupies the space between scan horn 34 and the surface of object 12. Preferably, chamber 100 occupies the maximum allowable space between scan horn 34 and the surface of object 12.

FIG. 1 shows an object 12 being conveyed along conveyor belt 22 beneath scan horn 34 and beam-transport device 40. As best seen in FIG. 2, second end member 46 of beam-transport device 40 is adjusted such that the lowermost surface of second end member 46 is slightly above object or product 12 on conveyor belt 22. In other words, only a slight gap or space exists between the upper surface of product 12 and the lowermost surface of second end member 46 of beam-transport device 40. A second product or object, different in dimensions from the first product, is shown in phantom in FIG. 2. Also shown in phantom is how beam-transport device 40 may be adjusted with respect to the second package.

Once the position of beam-transport device 40 is adjusted relative to product or object 12 to be irradiated, a vacuum is drawn within the chamber. A vacuum between about 0.1 Torr ($1.3\times10^{-4}$ atmospheres, 13.33 Pascals) and 0.01 Torr ($1.3\times10^{-5}$ atmospheres, 1.33 Pascals) is preferably established within chamber 100.

When e-beam 32 is created by electron accelerator 30, scan horn 34 causes e-beam 32 to move back and forth, forming a fan-like pattern 132, as schematically illustrated in phantom in FIG. 2. As e-beam 32 exits scan horn 34, it passes through panel 54 disposed within opening 52 in first end member 44 and enters chamber 100 within housing 42 of beam-transport device 40. E-beam 32 travels through chamber 100 and exits housing 42 through Change-panel 84 disposed within opening 82 in second end member 46. E-beam 32 exiting beam-transport device 40 irradiates product 12 passing under scan horn 34 and beam-transport device 40.

As e-beam 32 passes through chamber 100, a plasma is formed within chamber 100. The plasma is created by gas molecules in chamber 100 being ionized by e-beam 32. The scanning mode of e-beam 32 increases the number of gas molecules being ionized. As a result, a plasma is formed with concentrations of ions, electrons and neutral atoms that can be used for neutralization of the space charge of electron beam from accelerator. The plasma formed in chamber 100 has ions of oxygen and nitrogen, because of the air molecules within chamber 100. The vacuum within chamber 100 reduces the number of oxygen and nitrogen molecules within chamber 100. Under the vacuum condition, a rarified gas (air) is within chamber 100.

According to the present invention, the propagation of e-beam 32 in chamber 100 of beam transport device 40 preferably occurs under certain conditions within chamber 100 that result in the neutralization of the space charge within chamber 100, such that e-beam 32 is maintained as a tight, focused beam.

According to the present invention, a plasma with a desired, predetermined concentration of ions is created within chamber 100. Establishing the desired concentration of ions in chamber 100 is based upon the concentration of gas molecules in chamber 100 and the parameters of e-beam 32, namely the kinetic energy of e-beam 32 and the diameter of e-beam 32. In this respect, the concentration of molecules in chamber 100 and the energy and diameter of e-beam 32 as it scans through chamber 100, will determine the number of molecules of gas ionized by e-beam 32.

The number, i.e., the density, of gas molecules within chamber 100 is a function of the pressure of the gas within chamber 100. Vacuum generating system 114 reduces the pressure in chamber 100. Adjustments to the pressure level in chamber 100 may be performed using valve 118, which allows vacuum in chamber 100 to be "bled-off" to establish an optimum pressure level in chamber 100.

The concentration of ions in chamber 100 is a function of the concentration of molecules in chamber 100. As indicated above, the pressure level in chamber 100 is preferably established to create conditions suitable for neutralization of the space charge around e-beam 32.

A neutral space charge indicates there is no excess of ions or electrons in a given volume. The ideal conditions, i.e., a neutral space charge, for obtaining the desired beam containment occurs when:

$$\frac{n_i}{n_{eb}} \leq 1$$

where, $n_i$ is concentration of plasma ions, and $n_{eb}$ is concentration of electrons in e-beam 32.

The foregoing condition, i.e., $$\frac{n_i}{n_{eb}} \leq 1,$$

can also be expressed as a factor of space charge neutralization, $f_e$.

$$f_e = \frac{n_i}{n_{eb}}$$

The space charge neutralization factor, $f_e$, may also be expressed as:

$$1 \geq f_e \geq \frac{1}{\gamma^2}$$

where, $$\gamma = 1 + \frac{E\ [\text{MeV}]}{0.511\ [\text{MeV}]}$$

Figure 8:
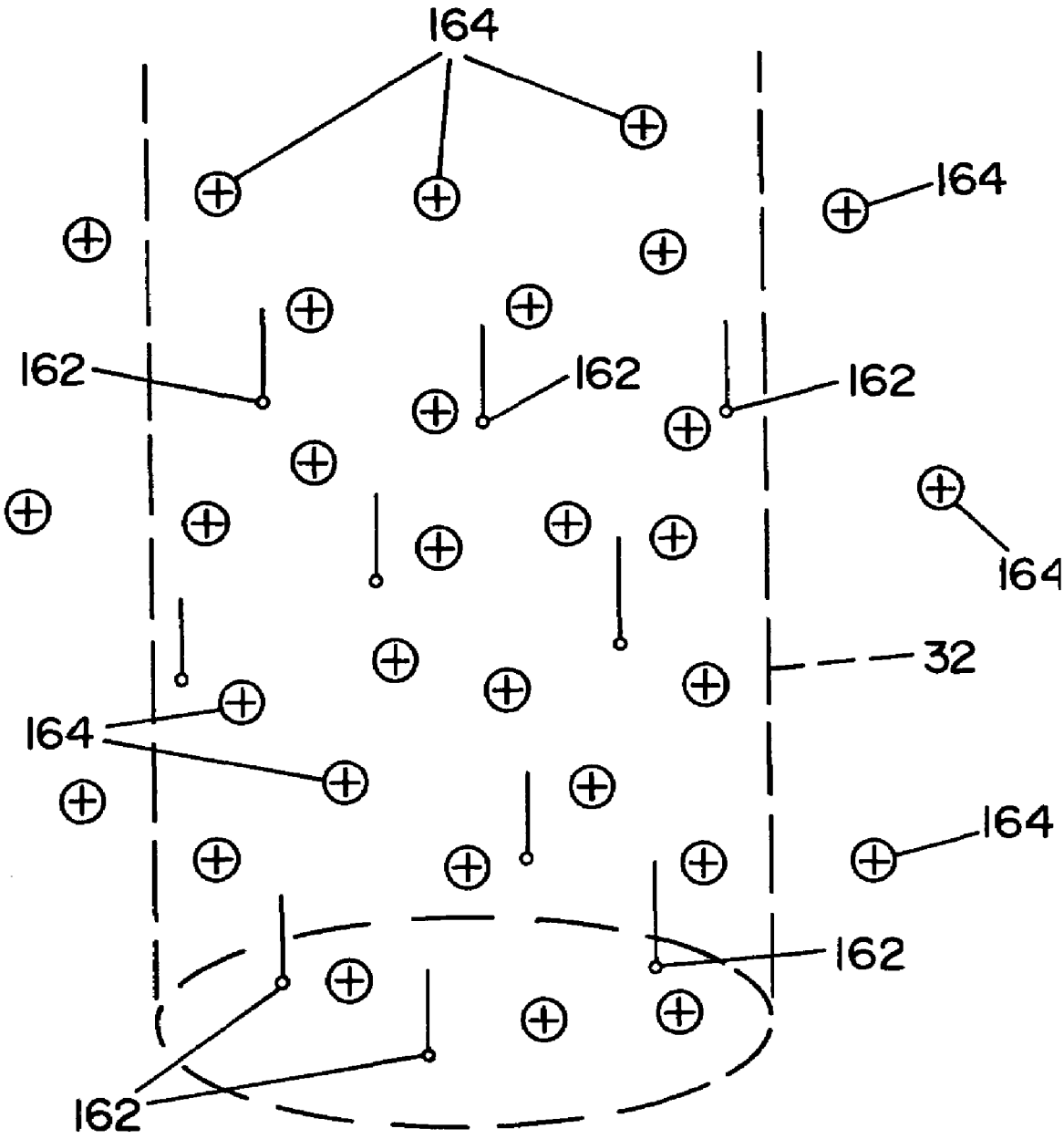
FIG. 8 is a pictorial illustration of a plasma and an e-beam propagated through the plasma.

FIG. 8 is a pictorial illustration showing electrons 162 from e-beam 32 and positive plasma ions 162 in chamber 100.

The e-beam 32 propagates across the plasma in chamber 100. In relation to the electrons in e-beam 32, the ions of oxygen and nitrogen within the plasma are large and heavy, and their velocity is relatively small. In this respect, the oxygen and nitrogen ions can be considered as stationary, i.e., non-moving, relative to the electrons in e-beam 32. The total charge in cross-section of e-beam 32 from accelerator is close to zero, and thus, a neutralization of the space charge of e-beam 32 exists. As a result, the diameter of e-beam 32 does not change within beam transport device 40.

As indicated above, the formation of plasma in chamber 100 by e-beam 32 depends on pressure of gas in chamber 100. The typical pressure in chamber 100 for a high current electron beam having a kinetic energy of 100–500 KeV and a current up to 2 kA is about $10^{-2}$–$10^{-1}$ Torr. The mechanism of ionization of the gas molecules in chamber 100 is determined by a collision of electrons of e-beam 32 with the gas molecules in chamber 100 (plasma-beam discharge). The neutralization of the space charge of e-beam 32 results in the dimensions of electron beams in cross-section being maintained.

The plasma formed by the ionization of gas molecules in chamber 100 can be considered as a medium for the transport or propagation of e-beam 32 without a change in the dimensions of e-beam 32 in cross section, as a result of the neutralization of the space charge around e-beam 32.

Beam-transport device 40 thus maintains the focus of e-beam 32 from scan horn 34 to object 12. As a result of the more stable e-beam 32, the energy levels required to irradiate a product may be lower because of the greater efficiency and less energy loss as compared to the same beam traveling through air from scan horn 34 to product 12.

Figure 7:
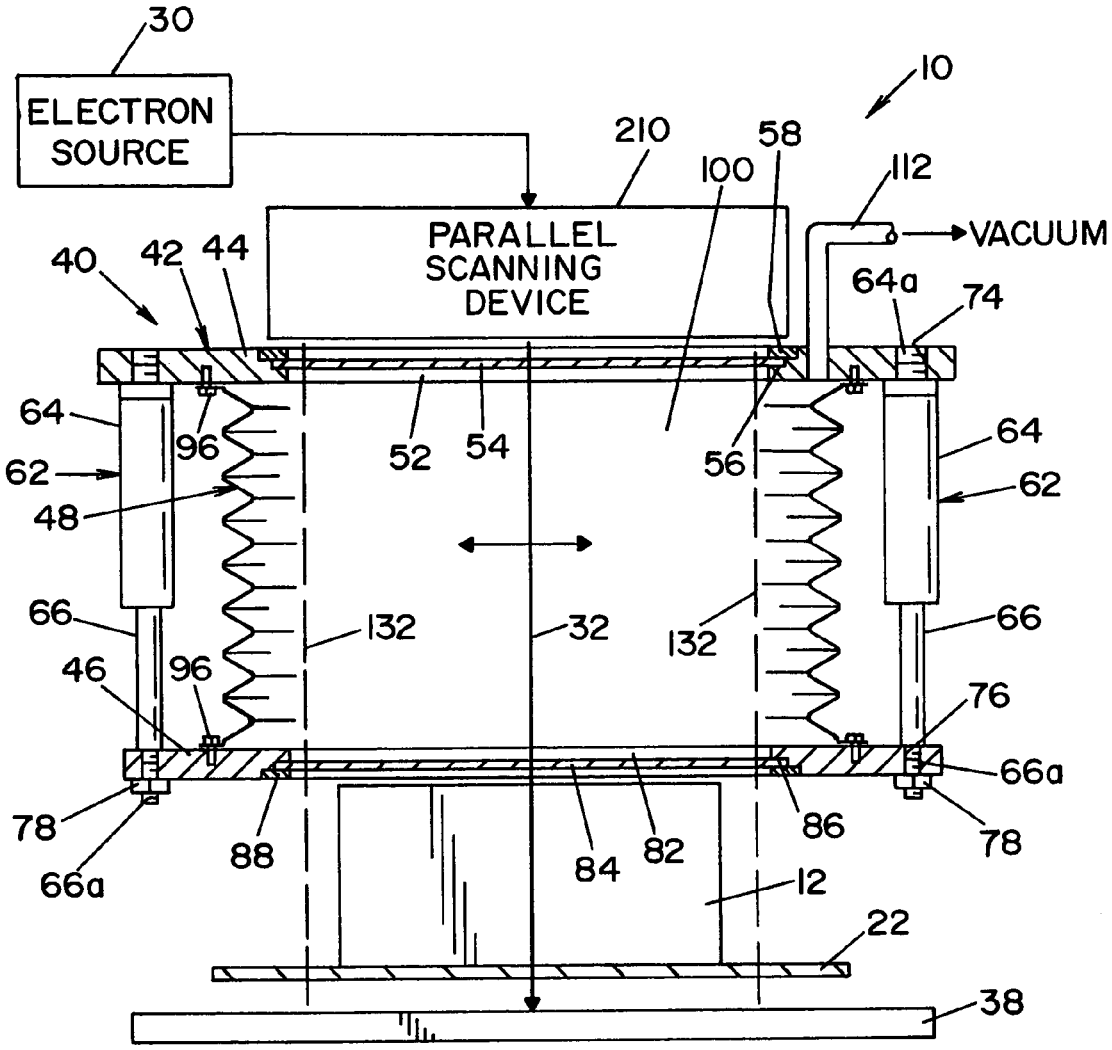
FIG. 7 is an elevational view of the e-beam transport device used with a parallel scanning device.

Referring now to FIG. 7, beam transport device 40 is shown with an electron accelerator 30 and a conventionally known, parallel scanning device 210. Parallel scanning device 210 is operable to move e-beam 32 back and forth through beam transport device 40 while maintaining e-beam 32 in a vertical position. FIG. 7 thus illustrates that beam transport device 40 finds advantageous application with a conventional scanning horn 30 or a parallel scanning device 210.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

What is claimed is:

1. A system for irradiating objects, comprising:

a conveyor for conveying objects along a predetermined path;

an e-beam scanning device disposed a predetermined distance from said path, said e-beam scanning device being operable to scan an e-beam across said path at a specific location along said path;

a chamber disposed between said scanning device and said specific location along said path, said chamber dimensioned to maintain said scanning e-beam within the confines of said chamber and to occupy a majority of the distance between said e-beam scanning device and an object at said specific location; and means for creating vacuum conditions in said chamber suitable for the creation of a plasma within said chamber when said e-beam is scanned through said chamber.

2. A system as defined in claim 1, wherein said e-beam enters and exits said chamber through metallic panels.

3. A system as defined in claim 1, wherein said chamber is adjustable in size.

4. A system as defined in claim 3, wherein said chamber is defined by a structure having a stationary, first end member disposed adjacent to said scanning device, a movable, second end member that is spaced from said first end member, and an expandable and collapsible, tubular wall member that is connected to said first and second end members.

5. A system as defined in claim 4, wherein said tubular wall member has an accordion-like structure.

6. A system as defined in claim 5, wherein said wall member is comprised of a flexible metal cloth that is coated with a polymer material.

7. A system as defined in claim 6, wherein said first and second end members are flat plates having openings therein, said metallic panel being disposed within said openings.

8. A system as defined in claim 7, wherein the ends of said tubular wall member are attached to said first and second end members.

9. A system as defined in claim 8, wherein said means for creating vacuum conditions in said chamber is a pump.

10. A method of irradiating an object, comprising the steps of:

providing a chamber between a source of an electron beam (e-beam) and an object to be irradiated by said electron beam, said chamber dimensioned to occupy a majority of the space between said source and said object; and maintaining a vacuum within said chamber while directing an e-beam through said chamber into said object, said vacuum in said chamber being at a level to create conditions within said chamber suitable for forming a plasma within said chamber.

11. A method as defined in claim 10, wherein said e-beam is scanned across said object.

12. A method as defined in claim 11, wherein said object is moving relative to said e-beam source.

13. A method as defined in claim 10, wherein said chamber includes a window for input of electron beam and a window for output electron beam, said metallic or plastic foil aligned along the path of said e-beam, wherein said e-beam enters said chamber through said window for input of electron beam and exits said chamber through said window for output electron beams.

14. A method as defined in claim 10, wherein said e-beam has a known number concentration of electrons in the e-beam and said vacuum in said chamber is at a level, wherein a number concentration of plasma ions is formed in a region surrounding the e-beam, and said vacuum is such that a ratio of the number concentration of plasma ions to the number concentration of electrons in the e-beam for a region surrounding the e-beam is less than or equal to 1.

15. An e-beam transport device, comprised of:

a housing defining a chamber, said housing dimensioned to withstand a vacuum of less than 2 Torr within said chamber;

window for input of electron beam and window for output electron beam forming a part of said housing, said foil oriented in said housing to be aligned with the path of an e-beam through said housing, wherein said e-beam enters said chamber through said window for input of electron beam and exits said chamber through said window for output electron beam; and a vacuum-generating device connected to said chamber, said vacuum-generating device capable of creating a vacuum between 2 Torr and 0.1 Torr within said chamber.

16. An e-beam transport device as defined in claim 15, wherein said housing can expand or contract to vary the size of said chamber.

17. An e-beam transport device as defined in claim 16, wherein said housing includes an accordion-like wall member.

18. An e-beam transport device as defined in claim 17, wherein said accordion-like wall member is comprised of polymer-coated wire cloth.

19. An e-beam transport device as defined in claim 18, wherein said housing includes a first end member and a second end member, said wall member being attached to said end members.

20. An e-beam transport device as defined in claim 19, wherein said first and second end members are flat plates having said metallic panels mounted therein.

21. An e-beam transport device as defined in claim 20, wherein said metallic panels are comprised of metal foil.

22. An e-beam transport device as defined in claim 15, wherein said vacuum-generating device is a vacuum pump.

23. An e-beam transport device as defined in claim 22, wherein said vacuum-generating device is capable of creating a vacuum between 0.10 Torr and 0.01 Torr with said chamber.

24. A method of irradiating an object, comprising the steps of:

positioning a chamber between a source of an electron beam (e-beam) and an object to be irradiated;

creating a vacuum within said chamber, said vacuum being at a level of 0.2 Torr or less; and scanning an e-beam through said chamber toward said object.

25. A method as defined in claim 24, wherein said e-beam has a known number concentration of electrons in the e-beam and said vacuum in said chamber is at a level, wherein a number concentration of plasma ions is formed in a region surrounding the e-beam, and said vacuum is such that a ratio of the number concentration of plasma ions to the number concentration of electrons in the e-beam for a region surrounding the e-beam is less than or equal to 1.

* * * * *